US007891196B2

(12) United States Patent
Trowell et al.

(10) Patent No.: US 7,891,196 B2
(45) Date of Patent: Feb. 22, 2011

(54) QUENCHLINE EXIT PLENUM FOR A CYROGENIC UNIT

(75) Inventors: Stephen Paul Trowell, Finstock (GB); Keith White, Abingdon (GB)

(73) Assignee: Siemens Plc, Frimley, Camberley, Surrey (GB)

( * ) Notice: Subject to any disclaimer, the term of this patent is extended or adjusted under 35 U.S.C. 154(b) by 713 days.

(21) Appl. No.: 11/180,604

(22) Filed: Jul. 14, 2005

(65) Prior Publication Data

US 2006/0185371 A1 Aug. 24, 2006

(30) Foreign Application Priority Data

Feb. 21, 2005 (GB) ..... 0503530.8

(51) Int. Cl.
*F17C 7/04* (2006.01)
*F17C 9/02* (2006.01)
*F25B 19/00* (2006.01)

(52) U.S. Cl. ..... 62/48.1; 62/46.1; 62/51.1; 62/53.2

(58) Field of Classification Search ..... 62/48.1, 62/53.2, 51.1, 46.1
See application file for complete search history.

(56) References Cited

U.S. PATENT DOCUMENTS 3,121,999 A * 2/1964 Kasbohm et al. ..... 62/46.1
3,747,504 A * 7/1973 Turko et al. ..... 454/59
4,803,433 A * 2/1989 McBride ..... 324/318
4,915,435 A * 4/1990 Levine ..... 296/24.38
5,117,640 A * 6/1992 Ginfrida, Jr. ..... 62/48.1
5,291,739 A * 3/1994 Woods et al. ..... 62/48.1
5,488,339 A * 1/1996 Havens et al. ..... 335/216
5,598,710 A * 2/1997 Tomeoku et al. ..... 62/51.1
5,727,353 A * 3/1998 Getz et al. ..... 52/79.1

* cited by examiner

*Primary Examiner*—Cheryl J Tyler
*Assistant Examiner*—John F Pettitt
(74) *Attorney, Agent, or Firm*—Crowell & Moring LLP

(57) ABSTRACT

A quench line and exit plenum configuration for a mobile MRI system housed in a transportable trailer includes an exit plenum with deflector plates that direct the quench flow of cold gases upward and away from surrounding objects. In addition, the plenum also includes dual vents to facilitate optimum gas flow and water drainage. The deflector plates are configured to utilize the Venturi effect to create an auxiliary flow of the ambient air to help deflect the flow of cold gases away from nearby pedestrians, when the magnet is quenching, and to enable service personnel to fill the magnet safely while in the vicinity of the exit plenum.

23 Claims, 2 Drawing Sheets

QUENCHLINE EXIT PLENUM FOR A CYROGENIC UNIT

The present invention is directed to a quench line and plenum arrangement for a mobile MRI system of the type which is generally housed in a trailer.

BACKGROUND OF THE INVENTION

Magnetic Resonance Imaging ("MRI") systems require the generation of an extremely strong magnetic field, which is generally measured in units referred to as "Tesla". (One Tesla=10,000 Gauss.) In order to achieve a magnetic field of this strength, it is generally necessary to employ superconducting magnets, which include coil windings that are cooled to temperatures on the order of a few degrees above absolute zero, using liquid helium as a coolant in the form of a cryogenic bath. Aside from the difficulties posed by the intense magnetic field itself, the handling of large quantities of such extremely cold liquid helium poses certain inherent difficulties.

One such difficulty is associated with the quenching of the superconducting coils of the magnet. "Quenching" in this context refers to a sudden loss of superconductivity in the wire that makes up the superconducting coils. As the coils start to exhibit normal resistive behavior, they heat up, causing the process to accelerate, so that the liquid helium "boils" off rapidly, releasing the magnet's stored energy in a process that can become somewhat violent. Moreover, the large volume (thousands of cubic meters) of evaporated liquid helium, which is released rapidly via a quench line remains extremely cold, and can cause injury, including "cold burns", to anyone who comes into contact with it. Asphyxiation is also a hazard.

Quenching may be performed intentionally, such as when it becomes necessary to shut down the magnetic field in order to prevent personnel or patient injury, or it may occur spontaneously due to a failure in the magnet system itself or an external influence. In either case, it is apparent that the manner in which the resulting discharge of evaporated helium gas is guided and vented to the exterior is extremely important. In particular, the design of the so-called "quench line" is significant, and must be configured so as to minimize the risk that people, animals or damageable objects will come into direct contact with the gas discharge. Moreover, it is also essential that the quench line be capable at all times of venting the evaporated helium at a rate that accommodates the rapid boiling in the cryogenic unit. If, for example, the quench line is inadequate or becomes constricted or clogged, a particularly dangerous situation can result. One such possibility is that moisture accumulates in the quench line, blocking it and causing helium gas to be vented into the examination area, which can result in asphyxiation.

Mobile MRI systems of the type mentioned previously are subject to all of the considerations described above, and in addition present their own unique design problems as well. For example, there is an increased risk of a spontaneous quench of the cryogenic cooling system due to "jostling" of the mobile MRI device between field locations. In addition to mechanical vibrations, systems are exposed to varying electromagnetic environments during transport which can also induce a quench. In addition, the necessity for movement of the trailer along routes populated by other vehicles is also of concern. For example, if the trailer is in a line of traffic, with a bus immediately behind, passengers at the front of the bus on the upper floor might be at risk of personal injury from cold gas in the event of a magnet quench. Similar risks have been identified to personnel working on ladders or raised platforms behind a mobile MRI system which is installed at a site. In order to address safety risks to service personnel, known mobile MRI systems have been designed to be refilled with liquid helium by service personnel located outside and to the rear of the trailer/housing, beneath the quench line exit.

To deal with these considerations, the exit of the quench line for mobile MRI systems must meet the following criteria:

- Provide a safe means of venting helium gas from the helium vessel under magnet service and quench conditions;
- Not generate a significant pressure drop, or restrict the gas flow;
- Inhibit the ingress of rain water, wind-borne debris and wildlife;
- Allow any water in the quench line to drain away;
- Be compatible with maximum trailer dimensions and national regulations regarding appendages to the exterior of the trailer;
- Minimize cost to manufacture; and
- Minimize the requirement for internal space within the trailer.

Conventional horizontal quench line exits do not direct quench flow gas away from pedestrians or bus passengers. During magnet depressurization and filling, air cooled by the released helium gas could impinge on service personnel beneath the exit grill. If the inner surface of the quench line exit is not angled downwards, condensation will reside in the quench line, with serious consequences if this migrates to the quench valve assembly.

Covers have been fitted to the exterior of horizontal quench line exit grills on previous MRI mobile installations, primarily to prohibit the ingress of rainwater. These designs were not favored by trailer manufacturers since appendages to the trailer are limited by road regulations (maximum trailer width), and compact cover designs can lead to large pressure drops for the quench gas flow. Hinged covers over exit grills are not permitted for any MRI installations (mobile or static) within the guidelines provided by Siemens Magnet Technology for quench line design (830-105HB2).

SUMMARY OF THE INVENTION

In view of the above safety concerns, one object of the present invention is to provide a quench line and exit plenum for a mobile MRI system, which exhibit an improved design with regard to venting of helium gas.

Another object of the invention is to provide such a quench line and exit plenum which reduces the risk to individuals close to the trailer when the cryogenic system quenches.

These and other objects and advantages are achieved by the quench line and exit plenum arrangement according to the invention, which includes an exit plenum with deflector plates that direct the quench flow of cold gases upward and away from surrounding objects. In addition, the plenum also includes dual vents to facilitate optimum gas flow and water drainage. The deflector plates are configured to utilize the Venturi effect to create an auxiliary flow of the ambient air, which combines with the cold gas flow, and helps to deflect it away from nearby pedestrians when the magnet is quenching, and to enable service personnel to fill the magnet safely while in the vicinity of the exit plenum.

DETAILED DESCRIPTION OF THE DRAWINGS

Figure 1:
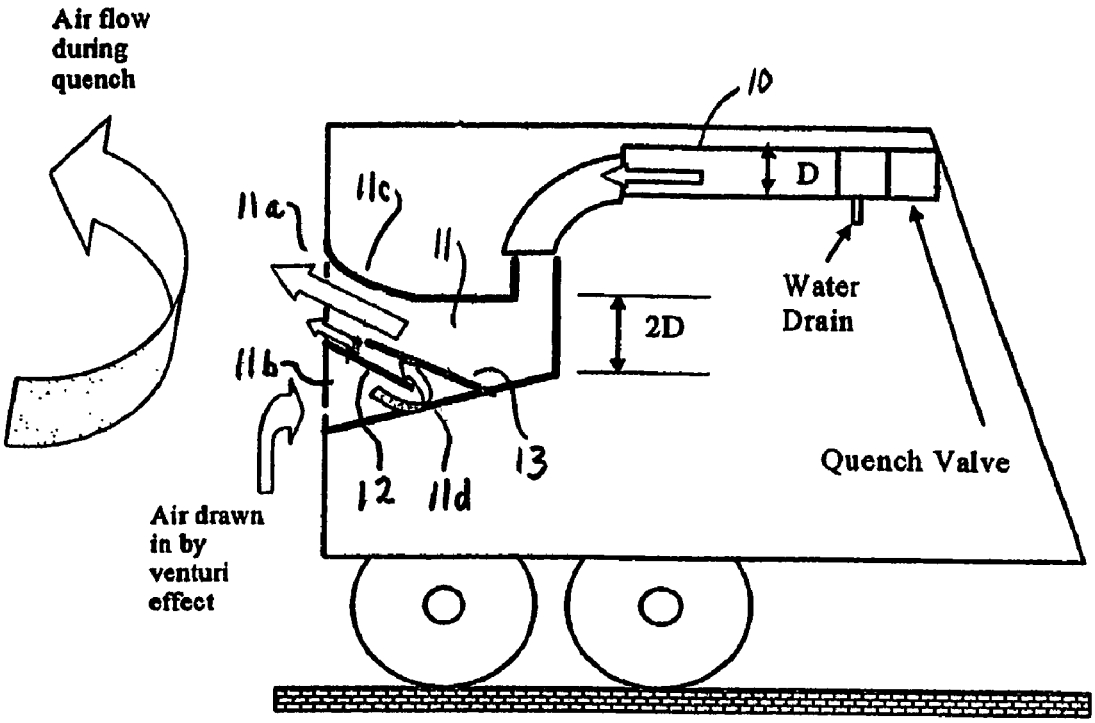
FIG. 1 is a side view of the quench line/exit plenum according to the invention, which shows the gas flow under magnet venting conditions.
Figure 2:
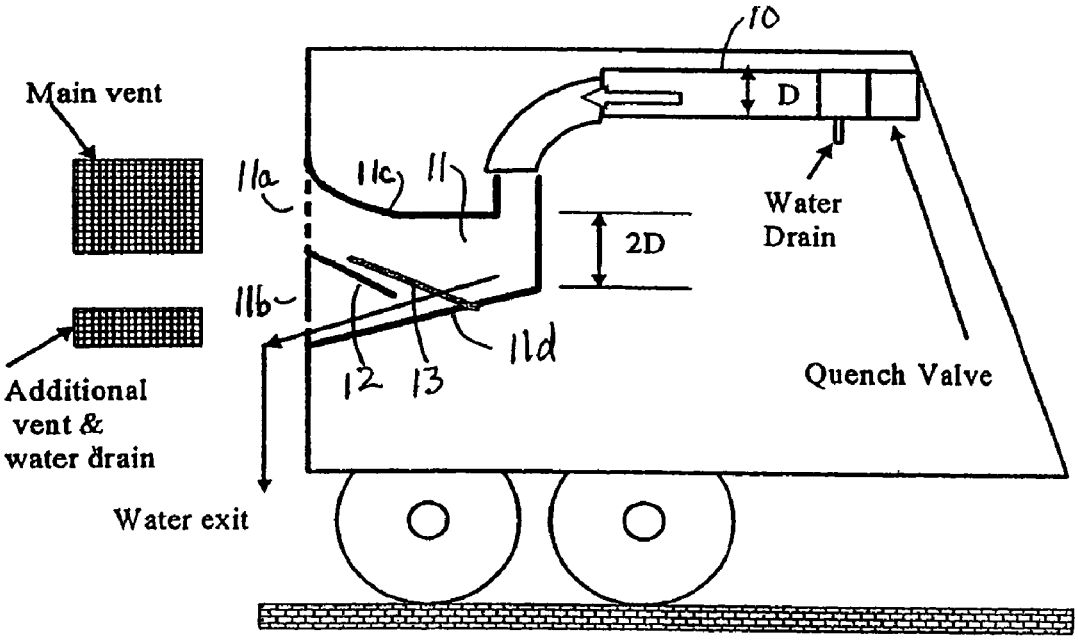
FIG. 2 is similar to FIG. 1, and shows water drainage via the plenum.
Figure 3:
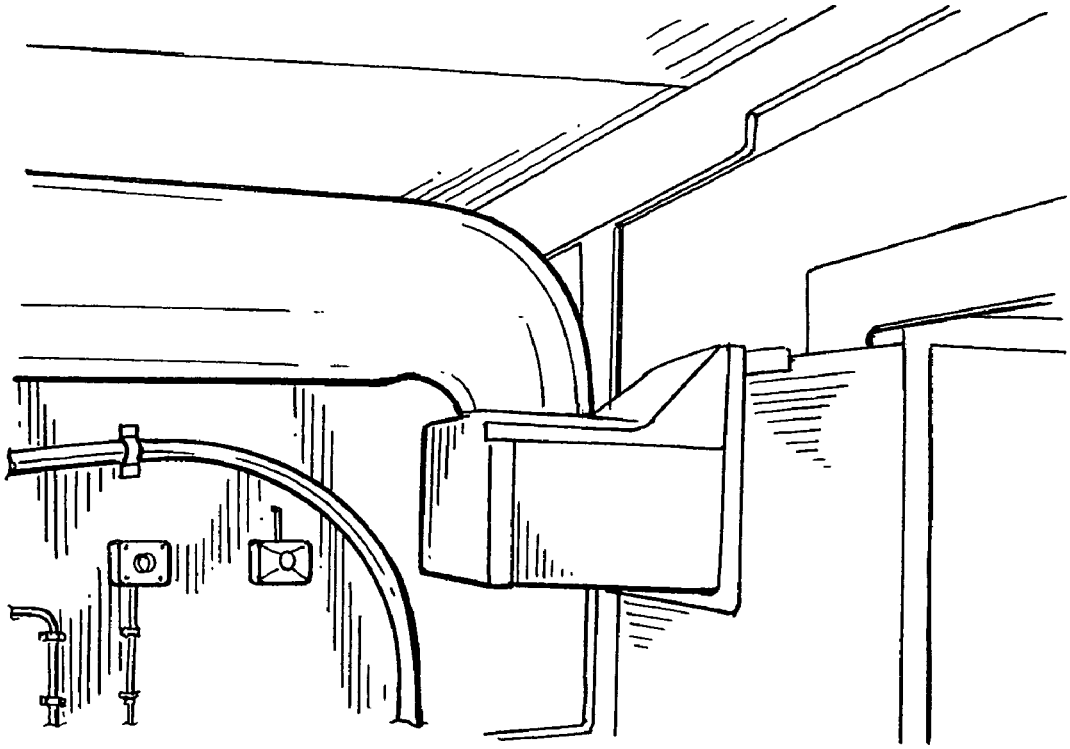
FIG. 3 is a perspective view of the exit plenum according to the invention, viewed from inside the trailer of a mobile MRI system.

FIGS. 1-3 illustrate a preferred embodiment of the quench line/exit plenum arrangement according to the invention, in which the system is vented to the exterior at the rear of the trailer that houses it.

FIG. 1 shows quench line 10 and exit plenum 11 mounted in a trailer which houses a mobile MRI system. In order not to restrict gas flow, for a quench line of diameter D, the plenum should be of minimum depth 2D. The plenum has two exit grills. The main vent 11*a* is sized for the quench flow. For safety reasons, gas flow is directed through this vent at an angle of approximately 45° to the vertical by two overlapping deflectors plates 12 and 13 and a curved upper surface 11*c*.

The secondary vent 11*b* and angled lower surface 11*d* enable effective water drainage from the plenum (FIG. 2). Holes in deflector plate 13 prevent water from collecting upstream of this plate. The deflector plates ensure that cold gas flow is not directed down towards pedestrians through the secondary vent grill when the magnet is venting. Furthermore, the overlap between deflector plates 12 and 13 generates a low pressure region by virtue of the Venturi effect, which draws air in through the secondary vent whenever cold gas exits the main vent, compounding the effect of deflecting the main gas flow upwards.

The plenum according to the invention was fitted to a mobile system, built by Medical Coaches, Oneonta, N.Y. It was mounted inboard so that there were no appendages to the rear of the trailer (FIG. 3). Alternative embodiments may include use of a single large vent grill; it is not essential to the operation of the plenum that two grills be used. Any means of water drainage through deflector plate 2 in FIG. 2 may be used, such as a small gap under the plate as well as, or instead of, holes in the plate. The plenum could be used on side exit quench lines, where space permits, as well as for rear exit quench lines. Embodiments of the design could apply to static installations, to improve safety related to the quench gas.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A mobile MRI system, comprising:

a cryogenic unit housed in a mobile trailer; and an apparatus for venting evaporated coolant from the cryogenic unit housed in the mobile trailer, the apparatus including a quench line connected to receive a flow of evaporated coolant gas from said cryogenic unit during a quench thereof;

a plenum coupled to said quench line and opening to an ambient environment surrounding said trailer via a main vent and a secondary vent; and first and second deflector plates mounted in said plenum; wherein said first and second deflector plates are stationary, substantially flat and together define a boundary between said main vent and said secondary vent;

said first and second deflector plates cooperate with an upwardly extending upper interior surface of said plenum to guide said gas flow in an upward direction relative to a surface that supports the trailer, as said gas exits the plenum;

said first and second deflector plates overlap each other and are separated by a gap that extends between said first and second deflector plates in an area of said overlap, said gap connecting said secondary vent with said main vent; and said first and second deflector plates are arranged so that an outward flow of evaporated gas from said cryogenic unit via said main vent causes ambient air to be drawn into the secondary vent, through the gap, and into the main vent where the ambient air is combined with said outward flow of evaporated gas.

2. The mobile MRI system according to claim 1, wherein said deflector plates have openings that permit water to drain from said plenum along a downwardly sloping lower inner surface of said plenum.

3. The mobile MRI system according to claim 2, wherein said openings in said deflector plates comprise holes having a size that permits water to flow through, but do not divert said flow of coolant gas.

4. The mobile MRI system according to claim 1, wherein said deflector plates deflect said gas flow upwardly at an angle of at least about 45° relative to horizontal.

5. The mobile MRI system according to claim 1, wherein said plenum opens to said ambient environment through one of a side wall and a rear wall of said trailer.

6. The mobile MRI system according to claim 1, wherein said ambient air flows through said gap substantially parallel to said outward flow.

7. The mobile MRI system according to claim 1, wherein an outer end of the first deflector plate is mounted on an outer wall of the plenum between the main vent and the secondary vent, and an inner end of the second deflector plate is mounted on a lower wall of the plenum.

8. An MRI system, comprising:

a cryogenic unit installed in a housing defined by front, side and rear walls; and an apparatus for venting evaporated coolant from the cryogenic unit installed in the housing defined by the front, side and rear walls, said apparatus including a quench line coupled to said cryogenic unit;

a plenum coupled to said quench line and having a main vent opening through a wall of said housing to an exterior of said housing; and deflector plates arranged in said plenum for deflecting a flow of evaporated coolant from said quench line upwardly as said flow of evaporated coolant exits said plenum through a main vent; wherein, said deflector plates, which are stationary and substantially flat, define a secondary vent in said plenum and separate the secondary vent from said main vent;

said deflector plates overlap each other to define an ambient air flow path that extends from the secondary vent between said overlapping deflector plates; and said deflector plates are arranged so that the flow of evaporated coolant out of said plenum through said main vent causes ambient air to be drawn into said plenum from said secondary vent by the Venturi effect, and the ambient air mixes with said flow of evaporated coolant via said ambient air flow path.

9. The MRI system according to claim 8, wherein said cryogenic unit is part of a mobile MRI system housed in a mobile trailer.

10. The MRI system according to claim 8, wherein said deflector plates have openings that permit water to drain from said plenum along a downwardly sloping lower inner surface of said plenum.

11. The MRI system according to claim 10, wherein said openings in said deflector plates comprise holes having a size that permits water to flow through, but does not divert said flow of coolant gas.

12. The MRI system according to claim 8, wherein said deflector plates deflect said gas flow upwardly at an angle of at least about 45° relative to horizontal.

13. The MRI system according to claim 8, wherein said plenum opens to said ambient environment through one of a side wall and a rear wall of said housing.

14. The mobile MRI system according to claim 8, wherein an outer end of a first deflector plate is mounted on an outer wall of the plenum between the main vent and the secondary vent, and an inner end of a second deflector plate is mounted on a lower wall of the plenum.

15. A plenum for venting an evaporated coolant flow from a quench line of a cryogenic unit housed in a mobile trailer, comprising:

a chamber connected to receive said evaporated coolant flow from said quench line of the cryogenic unit housed in the mobile trailer, and connected to guide said evaporated coolant flow to an exterior of said mobile trailer;

first and second deflector plates disposed in said chamber, for deflecting said evaporated coolant flow upwardly relative to a surface that supports the mobile trailer, as said evaporated coolant exits the chamber via a first vent of said chamber, the first and second deflector plates being stationary and substantially flat;

a second vent of said chamber delimited from said first vent by said first and second deflector plates;

wherein said first and second deflector plates overlap each other and are separated from each other by a gap which forms an ambient air flow path that extends between said plates in an area of said overlap, connecting said first and second vents, wherein said first and second deflector plates are arranged so that an outward flow of evaporated coolant through said plenum due to a quenching of said cryogenic unit causes ambient air to be drawn into said second vent, through the gap, and into the first vent.

16. The plenum according to claim 15, wherein said cryogenic unit is part of a mobile MRI system housed in said trailer.

17. The plenum according to claim 15, wherein said deflector plates have openings that permit water to drain from said plenum along a downwardly sloping lower inner surface of said plenum.

18. The plenum according to claim 15, wherein said openings in said deflector plates comprise holes having a size that permits water to flow through, but does not divert said flow of coolant gas.

19. The plenum according to claim 15, wherein said deflector plates deflect said gas flow upwardly at an angle of at least about 45° relative to horizontal.

20. The plenum according to claim 15, wherein said plenum opens to said ambient environment through one of a side wall and a rear wall of said trailer.

21. The plenum according to claim 15, wherein said first and second deflector plates are disposed in approximately parallel spaced apart relationship in an area of said overlap, said spacing apart forming said gap.

22. The plenum according to claim 21, wherein said gap draws ambient air into said second vent using the Venturi principle.

23. The mobile MRI system according to claim 15, wherein an outer end of the first deflector plate is mounted on an outer wall of the plenum between the first vent and the second vent, and an inner end of the second deflector plate is mounted on a lower wall of the plenum.

* * * * *